US008127869B2

(12) United States Patent
Vempati et al.

(10) Patent No.: US 8,127,869 B2
(45) Date of Patent: Mar. 6, 2012

(54) EARTH-BORING TOOLS, METHODS OF MAKING EARTH-BORING TOOLS AND METHODS OF DRILLING WITH EARTH-BORING TOOLS

(75) Inventors: Chaitanya K. Vempati, The Woodlands, TX (US); Jack T. Oldham, Conroe, TX (US); Suresh G. Patel, The Woodlands, TX (US); Danielle M. Fuselier, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/892,168

(22) Filed: Sep. 28, 2010

(65) Prior Publication Data

US 2011/0073369 A1 Mar. 31, 2011

Related U.S. Application Data

(60) Provisional application No. 61/246,409, filed on Sep. 28, 2009.

(51) Int. Cl.
*E21B 10/36* (2006.01)

(52) U.S. Cl. ..... 175/431; 175/57; 76/108.4

(58) Field of Classification Search ..... 175/57, 175/428, 426, 381, 382, 398, 431, 61
See application file for complete search history.

(56) References Cited

U.S. PATENT DOCUMENTS

| | | | |
|---|---|---|---|
| 4,815,342 | A | 3/1989 | Brett et al. |
| 5,033,560 | A | 7/1991 | Sawyer et al. |
| 5,109,935 | A | 5/1992 | Hawke |
| 5,119,892 | A | 6/1992 | Clegg et al. |
| 5,165,494 | A | 11/1992 | Barr |
| 5,186,268 | A | 2/1993 | Clegg |
| 5,238,075 | A | 8/1993 | Keith et al. |
| 5,265,685 | A | 11/1993 | Keith et al. |
| 5,346,025 | A | 9/1994 | Keith et al. |
| 5,549,171 | A | 8/1996 | Mensa-Wilmot et al. |
| 5,551,522 | A | 9/1996 | Keith et al. |
| 5,582,261 | A | 12/1996 | Keith et al. |

(Continued)

FOREIGN PATENT DOCUMENTS

EP 0569663 A1 11/1996

(Continued)

OTHER PUBLICATIONS

International Search Report for International Application No. PCT/US2010/050509 mailed Apr. 29, 2011, 4 pages.

(Continued)

*Primary Examiner* — William P Neuder
*Assistant Examiner* — Yong-Suk Ro
(74) *Attorney, Agent, or Firm* — Traskbritt

(57) ABSTRACT

Earth-boring tools comprise a body having a face at a leading end. A plurality of cutting elements are disposed over the face and configured as a plurality of kerfing pairs comprising two or more cutting elements disposed at substantially the same radial position relative to a bit axis, wherein each of the at least two cutting elements follows substantially the same cutting path when the bit is rotated about its axis. Earth-boring tools are further configured so that a summation of a lateral force generated during drilling by each cutting element of the plurality of cutting elements is directed toward a side of the body.

6 Claims, 5 Drawing Sheets

U.S. PATENT DOCUMENTS

| | | | | |
|---|---|---|---|---|
| 5,592,996 | A | | 1/1997 | Keith et al. |
| 5,607,025 | A | | 3/1997 | Mensa-Wilmot et al. |
| 5,651,421 | A | | 7/1997 | Newton et al. |
| 5,873,422 | A | | 2/1999 | Hansen et al. |
| 5,937,958 | A | * | 8/1999 | Mensa-Wilmot et al. .... 175/398 |
| 5,967,246 | A | | 10/1999 | Caraway et al. |
| 5,979,576 | A | | 11/1999 | Hansen et al. |
| 5,979,577 | A | | 11/1999 | Fielder |
| 5,992,547 | A | | 11/1999 | Caraway et al. |
| 6,062,325 | A | | 5/2000 | Taylor |
| 6,092,613 | A | | 7/2000 | Caraway et al. |
| 6,123,161 | A | | 9/2000 | Taylor |
| 6,164,395 | A | | 12/2000 | Fuller et al. |
| 6,302,223 | B1 | | 10/2001 | Sinor |
| 6,575,256 | B1 | | 6/2003 | Doster |
| 6,615,934 | B2 | | 9/2003 | Mensa-Wilmot |
| 6,971,459 | B2 | | 12/2005 | Raney |
| 7,000,715 | B2 | | 2/2006 | Sinor et al. |
| 7,308,957 | B2 | | 12/2007 | Cariveau et al. |
| 7,318,492 | B2 | | 1/2008 | Watson et al. |
| 7,455,125 | B2 | | 11/2008 | Sinor et al. |
| 2005/0080595 | A1 | | 4/2005 | Huang |
| 2006/0037785 | A1 | | 2/2006 | Watson et al. |
| 2006/0124358 | A1 | | 6/2006 | Mensa-Wilmot |
| 2006/0185901 | A1 | | 8/2006 | Sinor et al. |
| 2006/0254829 | A1 | | 11/2006 | Cariveau |
| 2006/0260845 | A1 | | 11/2006 | Johnson |
| 2007/0261890 | A1 | | 11/2007 | Cisneros |
| 2007/0267227 | A1 | | 11/2007 | Mensa-Wilmot |
| 2007/0278014 | A1 | | 12/2007 | Cariveau |
| 2008/0179106 | A1 | | 7/2008 | Gavia et al. |
| 2008/0302575 | A1 | | 12/2008 | Durairajan et al. |
| 2009/0065263 | A1 | | 3/2009 | Shen et al. |
| 2009/0084606 | A1 | | 4/2009 | Doster |

FOREIGN PATENT DOCUMENTS

| | | | |
|---|---|---|---|
| EP | 0869256 | A2 | 10/1998 |
| EP | 1627985 | A1 | 2/2006 |
| EP | 2039876 | A2 | 3/2009 |
| GB | 2252574 | A | 8/1992 |
| WO | 2006091641 | A1 | 8/2006 |
| WO | 2008073309 | A3 | 6/2008 |
| WO | 2008091654 | A2 | 7/2008 |
| WO | 2008091654 | A3 | 7/2008 |
| WO | 2008091654 | B1 | 7/2008 |
| WO | 2008092113 | A2 | 7/2008 |
| WO | 2008092113 | A3 | 7/2008 |
| WO | 2008092113 | B1 | 7/2008 |
| WO | 2008092130 | A1 | 7/2008 |
| WO | 2008092130 | B1 | 7/2008 |
| WO | 2008097843 | A3 | 8/2008 |
| WO | 2008118897 | A2 | 10/2008 |
| WO | 2009046075 | A2 | 4/2009 |
| WO | 2009061765 | A1 | 5/2009 |

OTHER PUBLICATIONS

International Written Opinion for International Application No. PCT/US2010/050509 mailed Apr. 29, 2011, 6 pages.

* cited by examiner

EARTH-BORING TOOLS, METHODS OF MAKING EARTH-BORING TOOLS AND METHODS OF DRILLING WITH EARTH-BORING TOOLS

CROSS-REFERENCE TO RELATED APPLICATION

This application claims the benefit of U.S. Provisional Patent Application Ser. No. 61/246,409, filed Sep. 28, 2009, the disclosure of which is hereby incorporated herein in its entirety by this reference.

TECHNICAL FIELD

The present disclosure relates generally to earth-boring tools and methods of forming earth-boring tools. More particularly, embodiments of the present invention relate to earth-boring tools, and methods of making earth-boring tools that exhibit favorable control and stability characteristics during use.

BACKGROUND

Rotary drill bits employing cutting elements such as polycrystalline diamond compact (PDC) cutters have been employed for several decades. PDC cutters are conventionally comprised of a disc-shaped diamond table formed on and bonded (under ultra-high pressure, ultra-high temperature conditions) to a supporting substrate such as a substrate comprising cemented tungsten carbide (WC), although other configurations are generally known in the art. Rotary drill bits carrying PDC cutters, also known as so-called "fixed cutter" drag bits, have proven very effective in achieving high rates of penetration (ROP) in drilling subterranean formations exhibiting low to medium hardness.

In harder subterranean formations, the weight applied on a downhole tool, such as a PDC bit (WOB), and similarly the torque applied to the tool, are typically limited to protect the PDC cutters. In order to obtain higher rates of penetration in hard subterranean formations, PDC bits may be used at increased rates of rotation (i.e., increased rotations per minute (RPM)). At higher RPMs, however, the bit may become particularly prone to dynamic dysfunctions caused by instability of the bit, which may result in damage to the PDC cutters, the bit body, or both.

Improvements in stability of rotary drill bits have reduced prior, notable tendencies of such bits to vibrate in a deleterious manner. Three approaches to realizing drilling stability have been independently practiced on bits, including anti-whirl or high-imbalance designs, low-imbalance designs, and kerfing.

The first stability approach involves configuring the rotary drill bit with a selected lateral imbalance force configuration and is conventionally referred to as a so-called "anti-whirl" bit. Bit "whirl" is a phenomenon wherein the bit precesses around the well bore and against the side wall in a direction counter to the direction in which the bit is being rotated. Whirl may result in a borehole of enlarged (over gauge) dimension and out-of-round shape and may also result in damage to the cutters and the drill bit. A so-called anti-whirl design or high-imbalance concept typically endeavors to generate a net lateral force (i.e., the net lateral force being the summation of each of the lateral drilling forces generated by each of the cutting elements disposed on a rotary drill bit) that is directed toward a gage pad or bearing pad that slidingly engages the wall of the borehole. Such a configuration may tend to stabilize a rotary drill bit as it progresses through a subterranean formation.

The second stability approach involves endeavoring to significantly reduce, if not eliminate, the net lateral force generated by the cutting elements so that the lateral forces generated by each of the cutting elements substantially cancel one another, and theoretically, the drill bit drills a straight path. This stability approach is conventionally referred to as a so-called "low-imbalance" design concept In the third approach to stabilize rotary drill bits while drilling, selective radial placement of cutting elements upon a rotary drill bit may create stabilizing grooves or kerfs, with intervening ridges in the bottom of the borehole being drilled. Accordingly, the grooves or kerfs in the formation material may cooperate with structure on the face of the bit and tend to mechanically inhibit the rotary drill bit from vibrating or oscillating during drilling. Of course, grooves or kerfs may not effectively stabilize the rotary drill bit if the magnitude of the net lateral force becomes large enough, or if torque fluctuations become large enough.

BRIEF SUMMARY

In some embodiments, the present invention includes earth-boring tools that comprise a body including a face at a leading end thereof and a plurality of cutting elements disposed over the face and configured as a plurality of kerfing pairs. Each kerfing pair may comprise two or more cutting elements disposed over the face at substantially the same radial position relative to a bit axis. Each of the two or more cutting elements of each kerfing pair follows substantially the same cutting path when the bit is rotated about its axis. A summation of a lateral force generated during drilling by each cutting element of the plurality of cutting elements may be directed toward a side of the body.

In additional embodiments, the present invention includes methods of making earth-boring tools. For example, a body may be formed that comprises a face at a leading end thereof, the face including a plurality of radially extending blades thereon. A plurality of cutting elements may be disposed on blades of the plurality of blades, such that some of the cutting elements of the plurality of cutting elements are configured to form kerfing pairs comprising at least two cutting elements disposed at least substantially at the same radial position from a central axis of the body. At least one of the plurality of blades and orientations and exposures of the plurality of cutting elements may be configured so that a summation of a lateral drilling force generated by each cutting element of the plurality of cutting elements is directed toward a lateral side of the body.

In yet further embodiments, the present invention includes methods of forming boreholes. An earth-boring tool may be rotated and a subterranean formation engaged with a plurality of cutting elements disposed on a plurality of blades extending radially over a face of the earth-boring tool. At least one groove may be formed in the subterranean formation with at least one cutting element of the plurality of cutting elements. At least one other cutting element of the plurality of cutting elements may follow the at least one cutting element at least substantially within the at least one groove. A predetermined net lateral force may be generated that acts against a sidewall of the borehole with a rotating side of the earth-boring tool. The predetermined net lateral force may comprise a summation of a lateral force generated during drilling by at least some cutting elements of the plurality of cutting elements.

In additional embodiments of methods of forming boreholes, a subterranean formation may be drilled with a rotary drill bit operating at a relatively low weight-on-bit (WOB). The rotary drill bit may comprise a plurality of cutting elements disposed over a face thereof. The rotary drill bit drilling at the low WOB may be stabilized with kerfs formed by cutting elements of the plurality of cutting elements. The WOB applied to the rotary drill bit increased to drill the subterranean formation with the rotary drill bit operating at a relatively high WOB, and the rotary drill bit drilling at the high WOB may be stabilized with a directed lateral force exerted by the rotary drill bit against a sidewall of the borehole. The directed lateral force may comprise a summation of a lateral force generated during drilling by each cutting element of the plurality of cutting elements.

BRIEF DESCRIPTION OF THE DRAWINGS

FIGS. 5-7 are graphs comparing various rotational speeds for an embodiment of the disclosure with various properties of the bit, wherein FIG. 5 is a graph illustrating the weight-on-bit (WOB) as a function of the torque for an embodiment of the disclosure used at various rotational speeds, FIG. 6 is a graph illustrating the WOB as a function of the rate of penetration (ROP) for an embodiment of the disclosure used at various rotational speeds, and FIG. 7 is a graph illustrating the torque as a function of the ROP for an embodiment of the disclosure used at various rotational speeds.

DETAILED DESCRIPTION

The illustrations presented herein are, in some instances, not actual views of any particular cutting element or drill bit, but are merely idealized representations that are employed to describe the present disclosure. Additionally, elements common between figures may retain the same numerical designation.

Figure 1:
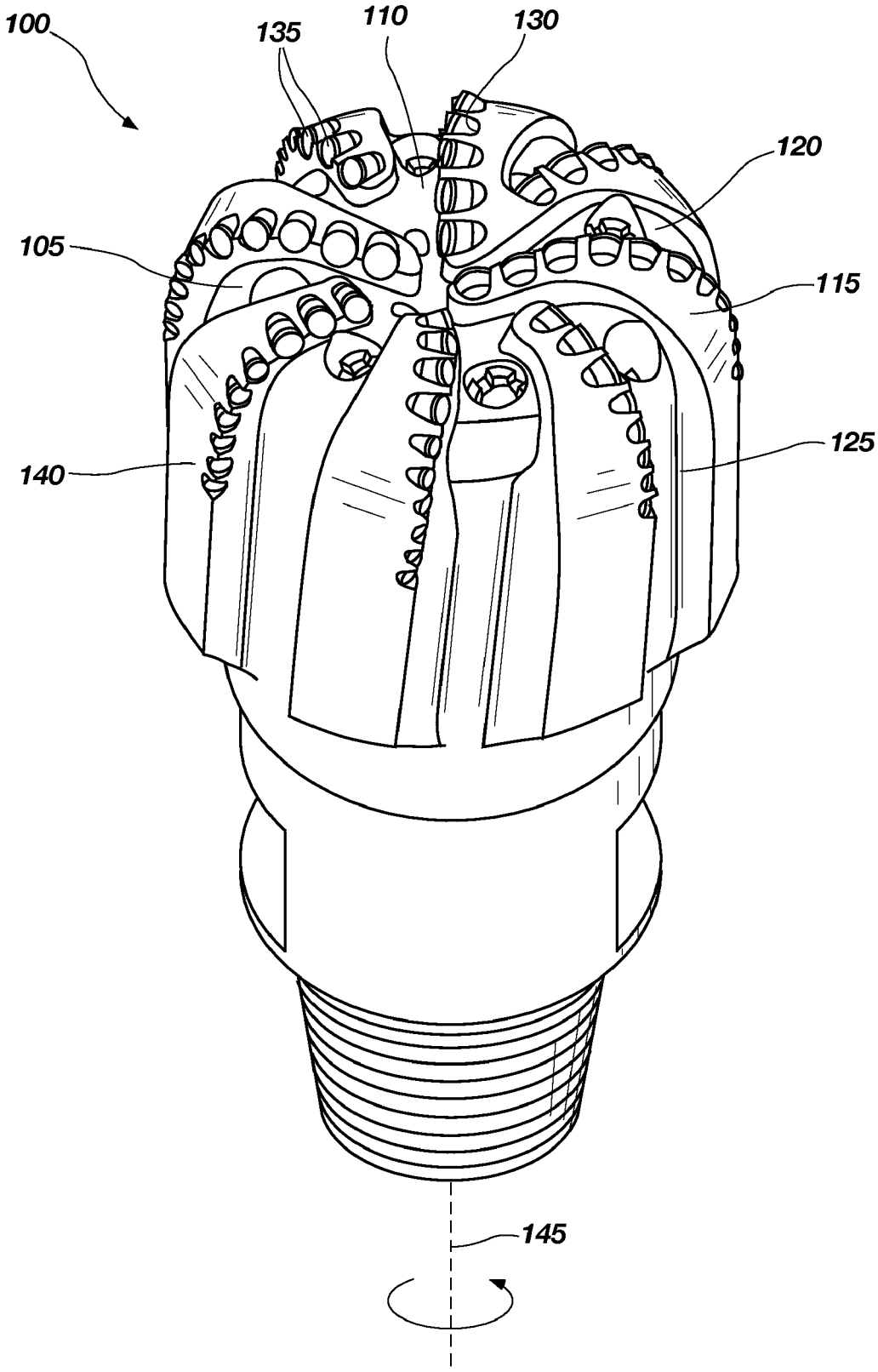
FIG. 1 is an isometric view of a drill bit in the form of a fixed cutter or so-called "drag" bit, according to an embodiment of the present disclosure.

Various embodiments of the present disclosure comprise earth-boring tools exhibiting favorable stability and control during use. As used herein, the term "earth-boring tool" means and includes bits, core bits, reamers and so-called hybrid bits, each of which employs a plurality of fixed cutting elements to drill a bore hole, enlarge a bore bole, or both drill and enlarge a bore hole. FIG. 1 is an isometric view of a rotary drill bit 100 in the form of a fixed cutter or so-called "drag" bit, according to an embodiment of the present disclosure. The drill bit 100 includes a body 105 having a face 110. The face 110 is defined by the external surfaces of the body 105 that contact the formation during drilling. The body 105 includes generally radially extending blades 115A-115H, which define fluid courses 120 therebetween that extending to junk slots 125 disposed between the gage sections of circumferentially adjacent blades 115A-115H. The body 105 may comprise a cemented tungsten carbide body (which may be formed by infiltration processes or pressing and sintering processes) or a steel body. Blades 115A-115H may also include pockets 130, which may be configured to receive cutting elements of one type such as, for instance, superabrasive cutting elements in the form of polycrystalline diamond compact (PDC) cutting elements 135.

Generally, such a PDC cutting element may comprise a superabrasive (diamond) mass that is bonded to a supporting substrate. Rotary drag bits employing PDC cutting elements have been employed for several decades. PDC cutting elements are typically comprised of a disc-shaped diamond "table" comprising a cutting face formed on and bonded under an ultra-high-pressure and high-temperature (HPHT) process to a supporting substrate formed of cemented tungsten carbide (WC), although other configurations are known. Such PDC cutting elements may be brazed into pockets in the bit face, pockets in blades extending from the face, or mounted to studs inserted into the bit body. Thus, PDC cutting elements 135 may be affixed upon the blades 115A-115H of drill bit 100 by way of brazing, welding, or any other suitable means. If PDC cutting elements 135 are employed, they may be back raked at a common angle, or at varying angles. It is also contemplated that cutting elements 135 may comprise suitably mounted and exposed natural diamonds, thermally stable polycrystalline diamond compacts, cubic boron nitride compacts, tungsten carbide, or diamond grit-impregnated segments, as well as combinations thereof as may be selected in consideration of the hardness and abrasiveness of the subterranean formation or formations to be drilled.

Also, each of the blades 115A-115H may include a gage region 140 that is configured to define the outermost radius of the drill bit 100 and, thus the radius of the wall surface of a borehole drilled thereby. Gage regions 140 comprise longitudinally upward (as the drill bit 100 is oriented during use) extensions of blades 115A-115H, extending from the nose portion and include cutting elements 135. The gage regions 140 may include additional wear-resistant coatings, such as hardfacing material on radially outer surfaces thereof.

Figure 2:
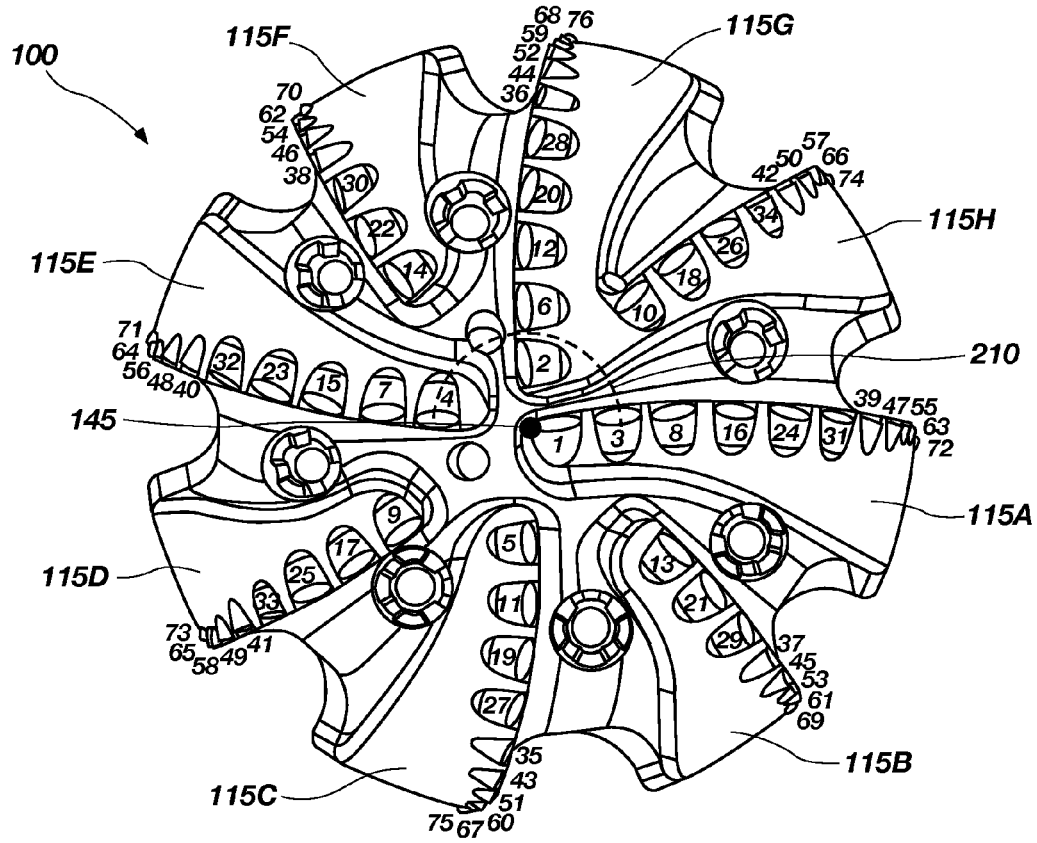
FIG. 2 illustrates a plan view of the face of the drill bit of FIG. 1.
Figure 3:
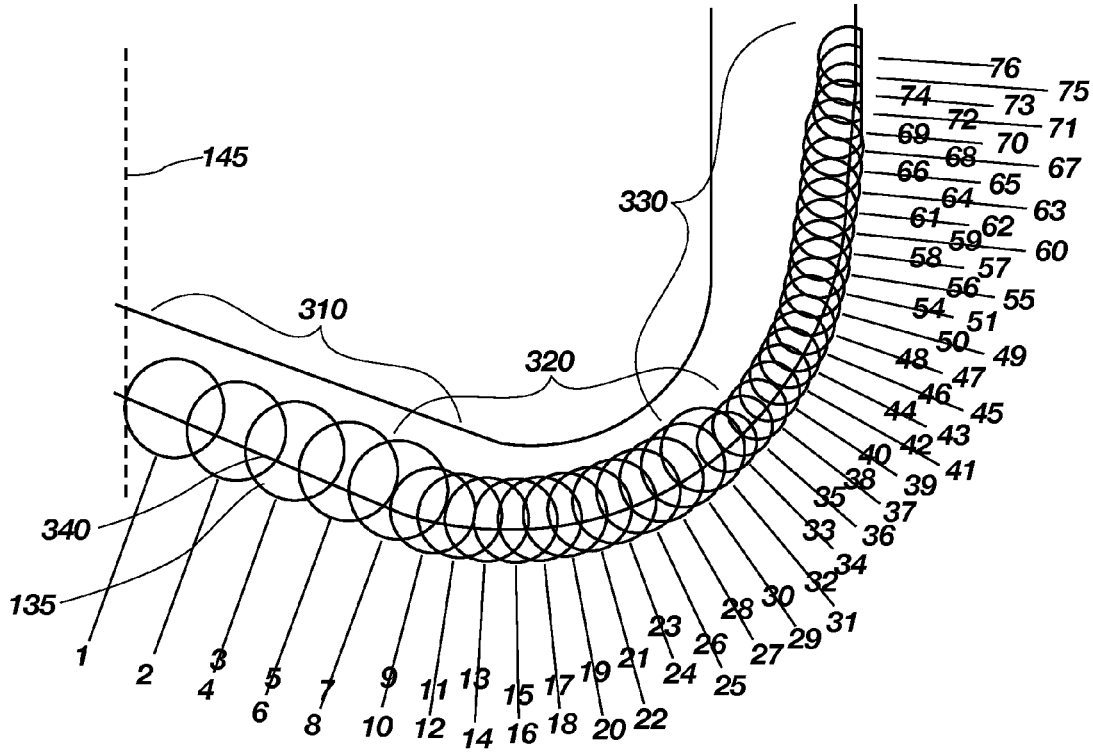
FIG. 3 shows a schematic view of the drill bit of FIG. 1 as if each of the cutting elements disposed thereon were rotated onto a single blade.

The cutting elements 135 of drill bit 100 are positioned and configured to stabilize and control the drill bit 100 during drilling. FIG. 2 illustrates a plan view of the face 110 of the drill bit 100. FIG. 3 shows a schematic view of the face profile of drill bit 100 as if each of the cutting elements 135 disposed thereon were rotated onto a single blade 115A-115H. As shown in FIGS. 2 and 3, the plurality of cutting elements 135 are positioned on the blades 115A-115H and are numbered from 1 to 76. The numbering scheme shown correlates to the radial position of the cutting elements 135 with relation to the bit axis 145. For example, the cutting element 135 identified by the number one (1) is the cutting element 135 closest to the bit axis 145, while the cutting element 135 identified by the number seventy-six (76) is positioned furthest from the bit axis 145.

At least some of the cutting elements 135 are positioned at the same or substantially the same radial position as one or more other cutting elements 135, albeit on different blades. Each such set of cutting elements 135 disposed at the same or substantially the same radial position may be referred to herein as a kerfing pair, which comprises two or more cutting elements 135. Thus, as used herein, the term "pair" is a term of art denoting at least two cutting elements, and not limiting a group of cooperating kerfing cutting elements to only two. For example, in the embodiment shown in FIGS. 2 and 3, the cutting elements identified as three (3) and four (4) are located at the same or substantially the same radial distance from the bit axis 145 and define a kerfing pair. By positioning the two or more cutting elements 135 at the same or substantially the same radial distance from the bit axis 145, the two or more cutting elements 135 will follow at least substantially the same path as the drill bit 100 rotates during drilling. The dotted line 210 of FIG. 2 illustrates the common path followed by the kerfing pair comprising the cutting elements 135 identified as three (3) and four (4) as the drill bit 100 is rotated about the bit axis 145.

As can be seen in FIG. 2, the cutting elements 135 identified as three (3) and four (4) comprising a kerfing pair are positioned rotationally spaced apart from each other on the face 110 of the drill bit 100 (e.g., on different blades 115A-115H). In such embodiments, the cutting elements 135 comprising each kerfing pair of the plurality of kerfing pairs are positioned on substantially opposing sides of the face 110 (e.g., rotationally about 180° from each other). For example, the cutting elements 135 of the first blade 115A are configured to comprise kerfing pairs with the cutting elements 135 of the fifth blade 115E. Similarly, the cutting elements 135 located on blades 115B and 115F, blades 115C and 115G and blades 115D and 115H are respectively configured to form kerfing pairs. However, other embodiments of a drill bit 100 may be configured differently. For example, the cutting elements 135 of blades 115A and 115B, blades 115C and 115D, blades 115E and 115F, and blades 115G and 115H of the drill bit 100 illustrated in FIG. 2 may be configured to form respective kerfing pairs. Other configurations will be apparent to one of ordinary skill in the art.

In operation, as the drill bit 100 is rotated about the bit axis 145 in a borehole, a rotationally leading cutting element 135 of a kerfing pair scrapes along the borehole bottom surface and cuts into the subterranean formation material, shearing off formation material to form a groove, which may also be characterized herein as a kerf, in the surface. The one or more rotationally following cutting elements 135 of the kerfing pair, which follow the same path as the rotationally leading cutting element 135 (e.g., the cutting element 135 identified as four (4) may follow the same path as the cutting element 135 identified as three (3)), will at least substantially enter into and follow within the same groove formed by the rotationally leading cutting element 135. The one or more rotationally following cutting elements 135 of each kerfing pair will further be substantially restrained from lateral movement by the sidewalls of the groove within which the following cutting elements 135 track.

In some embodiments, rotationally following cutting elements 135 of a kerfing pair may lie on blades having different blade profiles from the blade on which the rotationally leading cutting element 135 lies. For example, the blades on which the rotationally leading cutting element 135 is disposed may comprise a blade profile that is less rounded than the blades on which the rotationally following cutting elements 135 are disposed. In addition, or alternatively, the rotationally following cutting elements 135 of a kerfing pair may have different relative exposures from the rotationally leading cutting element 135. Further, the rotationally leading and rotationally following cutting elements 135 of a kerfing pair may comprise different shapes, chamfers, rakes, diamond grades, diamond abrasion resistance properties, impact resistance properties, etc., as well as combinations thereof. In some embodiments, the cutting elements 135 of a kerfing pair may be disposed at radial distances from the bit axis 145 that are only substantially the same. As referred to herein, distances that are "substantially the same radial distance" are radial distances that differ by 0.200 in. (about 5.08 mm) or less.

The drill bit 100 may further be configured to comprise selectively varied aggressiveness in two or more portions of the drill bit 100. For example, the drill bit 100 may be selectively configured to be less aggressive in the nose region, the shoulder region, or in both the nose and shoulder regions, while being more aggressive in the cone region, the nose region, or in both the cone and nose regions. As used herein, the aggressiveness of the drill bit 100 refers to the relative volume of subterranean formation material that is removed by one or more cutting elements 135 on each rotation of the drill bit 100. A high aggressiveness refers to a relatively larger volume of subterranean formation material being removed by one or more cutting elements 135 on each rotation of the drill bit 100, while a low aggressiveness refers to a relatively smaller volume of subterranean formation material being removed by one or more cutting elements 135 on each rotation of the drill bit 100. According to various embodiments, the drill bit 100 may include varying sized cutting elements 135, varying exposures for the cutting elements 135, or combinations thereof to control the aggressiveness of the drill bit 100 in various regions of the drill bit 100.

FIG. 3 illustrates an embodiment employing a combination of multiple cutter sizes and varying exposures to reduce the aggressiveness of the drill bit 100 in the nose region, the shoulder region, and the gage region of the drill bit 100, relative to the aggressiveness of the drill bit 100 in the cone region. The plurality of cutting elements 135 may comprise two or more groups made up of multiple cutting elements 135, each group of cutting elements 135 having a respective size of cutting face. In particular, a first group 310 of cutting elements 135 is located proximate the bit axis 145 and a second group 320 of cutting elements 135 may be located radially outward from the first group 310 relative to the bit axis 145. For example, the first group 310 of cutting elements 135 may be at least substantially located in the cone of the drill bit 100, while the second group 320 of cutting elements 135 may be located radially outward from the cone region (e.g., in at least one of the nose region, the shoulder region, and the gage region of the drill bit 100). In the embodiment of FIG. 3, the second group 320 of cutting elements 135 is disposed in the nose region of the drill bit 100 and a portion of the shoulder region of the drill bit 100.

The cutting elements 135 comprising the first group 310 have larger cutting faces than the cutting elements 135 comprising the second group 320. By way of example and not limitation, the first group 310 of cutting elements 135 may comprise substantially round cutting faces that are sized between about 4 mm and about 30 mm in diameter, while the second group 320 of cutting elements 135 may comprise similarly shaped cutting faces that are also sized between about 4 mm and about 30 mm in diameter, so long as the cutting elements of the second group 320 of cutting elements 135 are sized smaller than the first group 310 of cutting elements 135. In at least one non-limiting embodiment, the cutting elements 135 comprising the first group 310 may each have a cutting face of about 13 mm in diameter and the cutting elements 135 comprising the second group 320 may each have a cutting face of about 11 mm in diameter.

In additional embodiments, three or more groups of cutting elements 135 may be employed, each group comprising differing sizes of cutting faces. For example, FIG. 3 illustrates a third group 330 of cutting elements positioned radially outward from the second group 320 of cutting elements 135 relative to the bit axis 145. In the embodiment of FIG. 3, the second group 320 of cutting elements 135 is disposed in a portion of the shoulder region of the drill bit 100 and the gage region of the drill bit 100.

The cutting elements 135 of the third group 330 have a smaller cutting face than cutting elements 135 of the second group 320. The third group 330 of cutting elements 135 may comprise cutting faces sized between about 4 mm and about 30 mm in diameter, so long as the cutting elements 135 of the third group 330 are sized smaller than the cutting elements 135 of the second group 320.

In at least one non-limiting embodiment, the cutting elements 135 of the first group 310 may each have a cutting face of about 13 mm in diameter, the cutting elements 135 of the second group 320 may each have a cutting face of about 11 mm in diameter, and the cutting elements 135 of the third group 330 may each have a cutting face of about 8 mm in diameter.

In still other embodiments, the two or more groups of cutting elements 135 may be configured and located opposite of the examples described above. For example, the cutting elements 135 of the first group 310, which are located proximate the bit axis 145 may comprise smaller cutting faces than the cutting elements 135 of the second group 320, which are located radially outward from the first group 310.

In addition to, or in the alternative to providing two or more groups of cutting elements 135 having different sizes, as described above, the cutting elements 135 may be positioned on the drill bit 100 at varying relative exposures to selectively configure the aggressiveness of the drill bit 100 in various locations of the bit. As used herein, the term "exposure" of a cutting element 135 generally indicates the distance by which the cutting element 135 protrudes above a portion of the drill bit 100, for example a blade surface 340 or the profile thereof, to which it is mounted. In reference specifically to the present disclosure, "relative exposure" is used to denote a difference in exposure between various cutting elements 135. More specifically, the term "relative exposure" may be used to denote a difference in exposure between one cutting element 135 and another cutting element 135. One or more embodiments of the disclosure may be configured with the cutting elements 135 in or near the nose or the shoulder or both having a relative exposure less than the relative exposure of the cutting elements 135 in the cone. For example, in FIG. 3, the cutting elements comprising the first group 310 and the second group 320, which are respectively located substantially in the cone and the nose of the drill bit 100, comprise a greater relative exposure than the cutting elements 135 comprising the third group 330 located substantially in the shoulder of the drill bit 100. Various combinations of cutting element size and relative exposure may be employed in accordance to various embodiments of the disclosure to tailor the aggressiveness of the drill bit 100 according to a particular application.

By selectively configuring the aggressiveness of the drill bit 100, either by providing two or more groups of cutting elements 135 with different sizes of cutting faces or by adjusting the relative exposure of the cutting elements 135 or a combination thereof, the lateral aggressiveness of the drill bit 100 may be relatively low while the axial aggressiveness may be relatively high. If the drill bit 100 whirls during drilling, causing the drill bit 100 to precess around the borehole and against the side wall of the borehole, the relatively low aggressiveness of the cutting elements 135 toward the radially outward portions of the drill bit 100 (relative to the bit axis 145) may gouge less formation material at the side wall of the borehole. By gouging, or penetrating, less formation material, the forces on the drill bit 100 causing the drill bit 100 to precess around the borehole may be reduced, which may result in inhibiting the precession of the drill bit 100 and aid in stabilizing the drill bit 100 during drilling.

Providing larger cutting elements 135 and/or cutting elements with greater relative exposures in the cone or nose, or both, as described herein above, may further improve the stability of the drill bit 100 by forming deeper grooves in the formation material in contact with the cone and/or nose, resulting in grooves with larger sidewalls. The larger sidewalls of the grooves in the nose and cone of the drill bit provides a larger and more robust lateral bearing surface by which any lateral movement of the following cutting elements 135 of the multiple kerfing pairs may be restrained, as described above. Furthermore, embodiments employing smaller cutting elements 135 in the shoulder of the bit may result in a relatively higher diamond volume in the shoulder region where most wear to the drill bit is typically seen, a greater opportunity for providing backup cutting elements, the production of smaller chips, increased impact resistance due to a relatively larger number of cutters in the shoulder region, a relatively smoother borehole, reduced torque and decreased weight transfer issues in the borehole.

Figure 4:
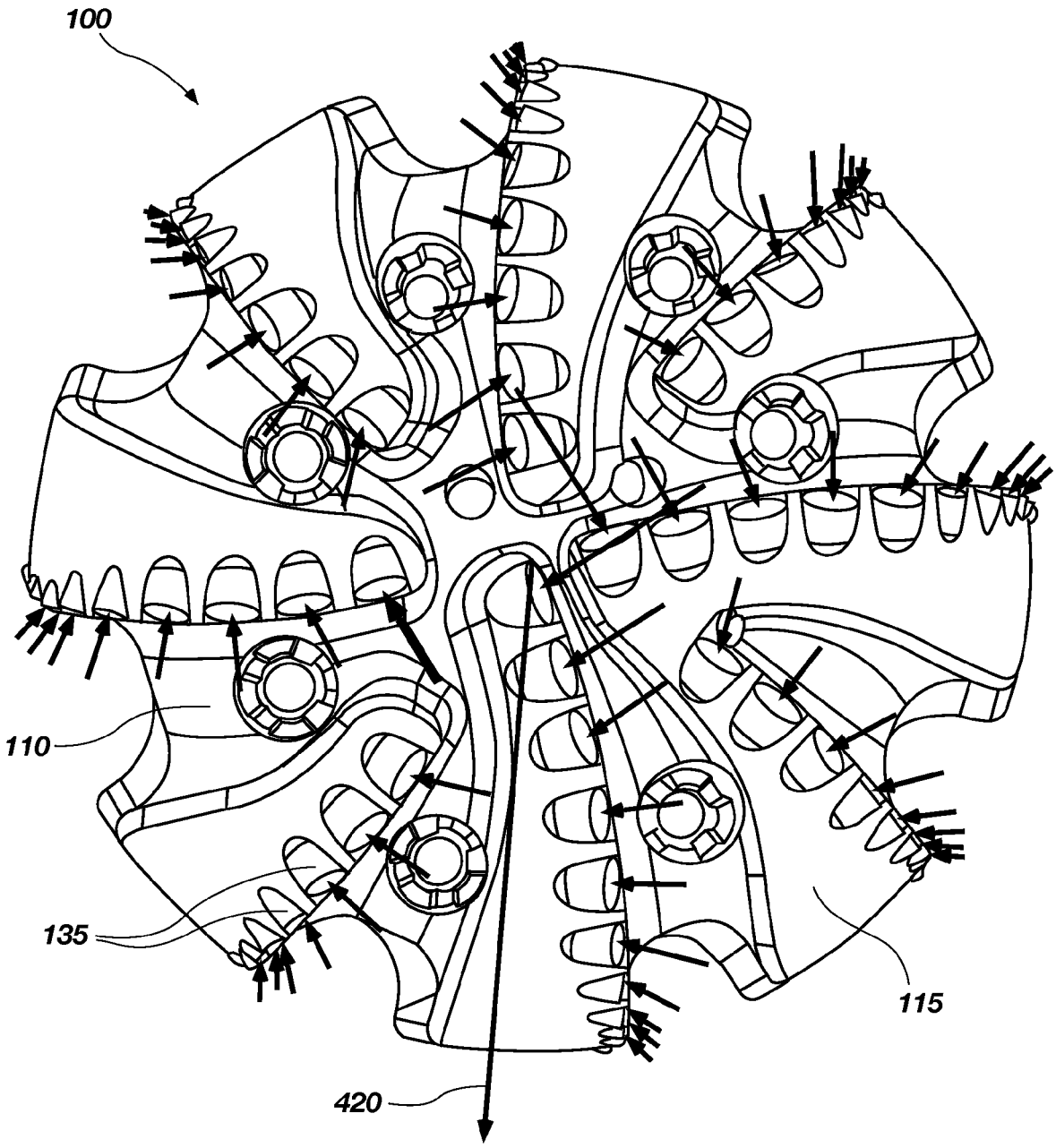
FIG. 4 illustrates a plan view of the face of the drill bit of FIG. 1 depicting the force vector applied on each of the cutting elements in use.

Various embodiments of drill bits of the present disclosure may be further configured to generate a directed net lateral force (i.e., the net lateral force being the summation of each of the lateral drilling forces generated by each of the cutting elements 135 disposed on the drill bit 100) toward a side of the drill bit 100, the directed net lateral force being sufficient to stabilize the drill bit 100 as it progresses through a subterranean formation. FIG. 4 illustrates a plan view of the face 110 of the drill bit 100 including arrows representing the reactive force vector applied on each of the cutting elements 135 as the cutting elements engage subterranean formation material during drilling. In the embodiment shown in FIG. 4, the cutting elements 135 are located and positioned on the blades 115A-115H, which blades 115A-115H are also located and configured on the face 110 of the drill bit 100 to generate a net imbalance force in the direction shown by arrow 420.

By way of example and not limitation, the blades 115A-115H may be configured to extend asymmetrically over the face 110, such as by configuring some blades 115A-115H to extend nearer to the bit axis 145 than other blades 115A-115H, etc., so that the cutting elements 135 disposed on the blades 115A-115H may be subjected to a reactive force by a formation during drilling in the directions indicated by arrows. By aligning the cutting elements 135 on the asymmetrical blades 115A-115H, as shown, the sum total of all of the force vectors results in a net lateral force, which may also be referred to herein as a net imbalance force, in the desired direction of the arrow 420. In other embodiments, the net lateral force may be alternatively or additionally generated by disposing the blades to comprise a spiral as they extend radially outward, or by selectively disposing cutting elements 135 having different sizes, different relative exposures, different side and back rakes, as well as combinations thereof.

The magnitude of the net lateral force is generally a percentage of the weight applied on the bit, conventionally referred to as weight-on-bit (WOB). The drill bit is configured so that the net lateral force is of sufficient magnitude to stabilize the drill bit 100 during use. By way of example and not limitation, the net lateral force may be between about 8% and about 25% of the applied WOB.

Embodiments of drill bits 100 of the present disclosure that employ a combination of a net lateral force configuration and a plurality of kerfing pairs as described above, have been found to provide a substantially improved stability of the drill bit 100 over a relatively broad range of weights-on-bit (WOB). In particular, the net lateral force configuration contributes to bit stability primarily at relatively high weights on bit while the kerfing pairs contribute to bit stability primarily at relatively low weights on bit. By way of example and not limitation, the relatively high weights may be weights above about 20,000 lb and relatively low weights may include weights below 20,000 lb.

Figure 5:
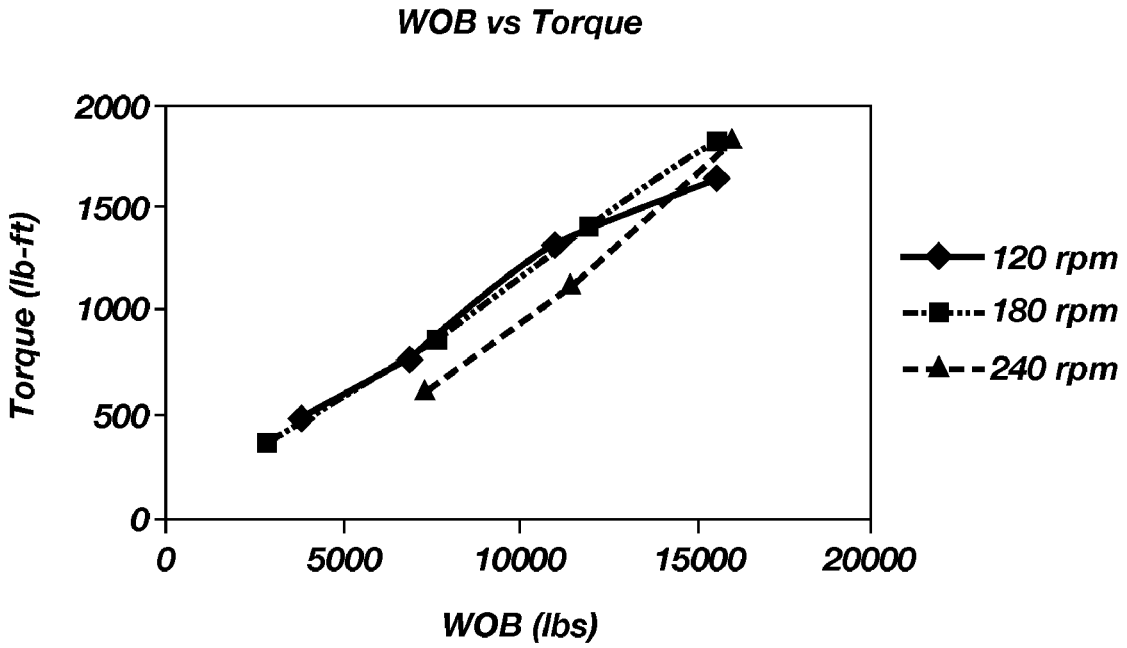
Figure 6:
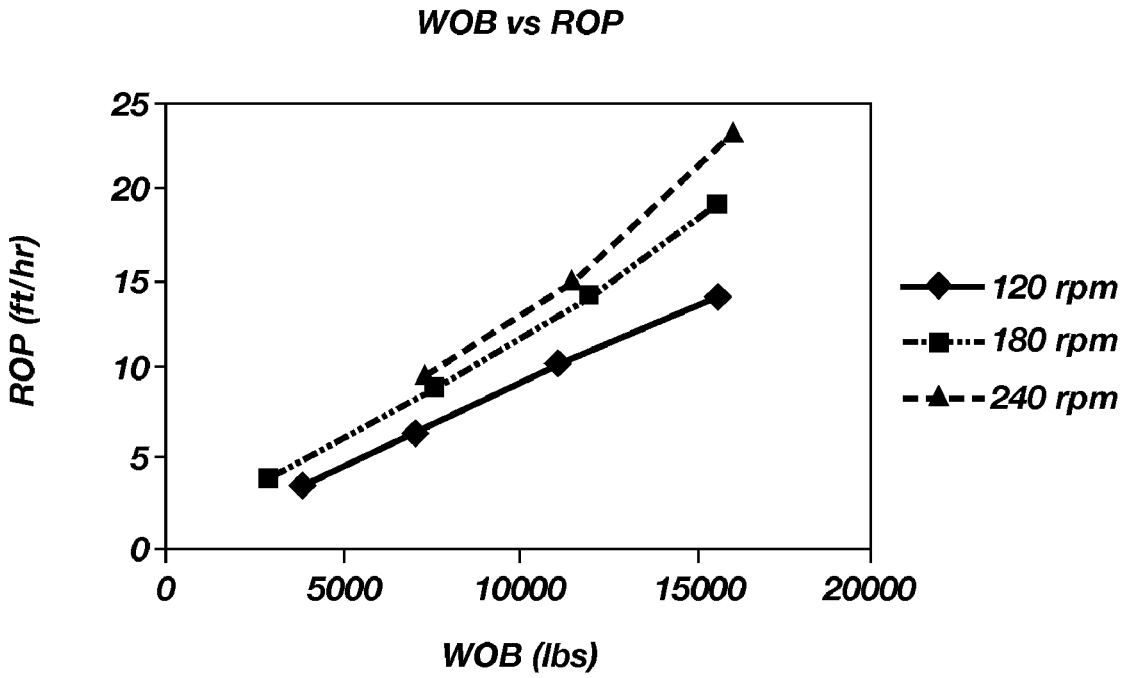
Figure 7:
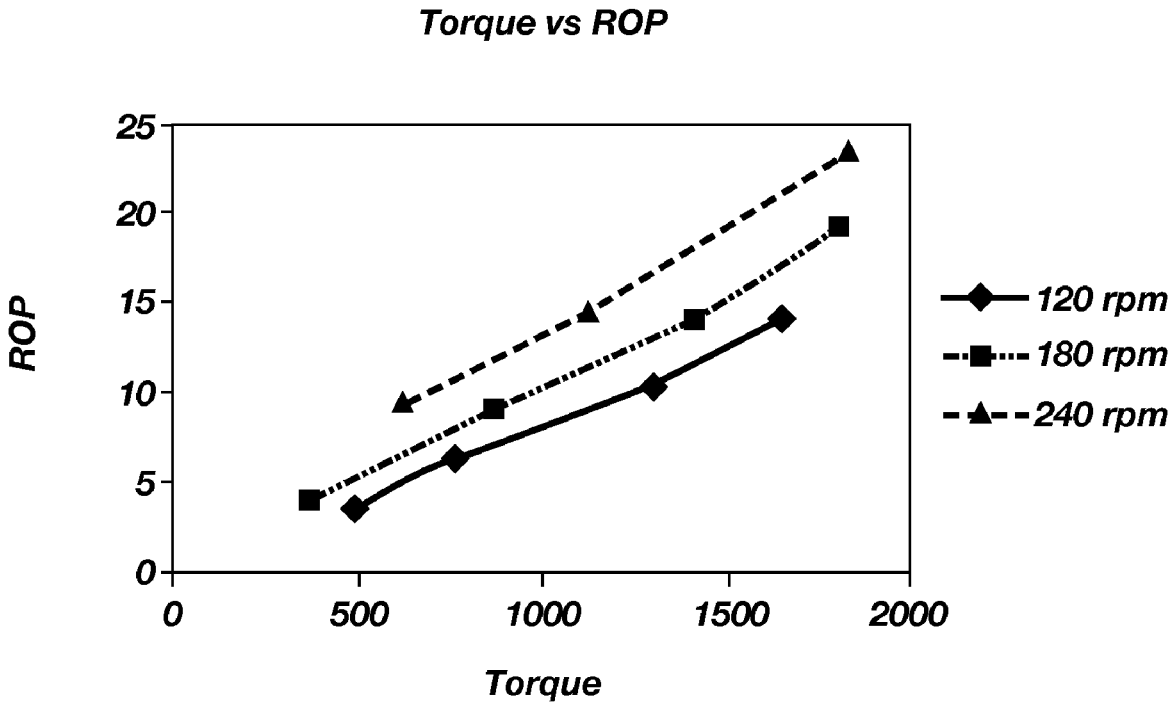

Referring to FIGS. 5-7, graphs are shown comparing various rotational speeds for an embodiment of the disclosure with various properties of the bit, including the WOB as a function of the torque (FIG. 5), the WOB as a function of the rate of penetration (ROP) (FIG. 6) and the torque as a function of the ROP (FIG. 7).

As illustrated in FIG. 5, an embodiment of the a bit of the present disclosure is less aggressive in terms of torque at 240 rpm compared to 120 rpm and 180 rpm at lower WOB, but torque increases to that exhibited at lower rpms when the WOB is about 15,000 lb. Furthermore, embodiments of the disclosure become more efficient as the rotational speed is increased. Referring to FIG. 7, for example, the bit drills four (4) feet/hour faster at a rotational speed of 240 rpm compared to 180 rpm, and six (6) feet/hour faster compared to 120 rpm. It is believed that even at low weights on bit, most of the energy applied to a bit of the present disclosure goes primarily into drilling the subterranean formation material and less into any dysfunctions that reduce the efficiency of the bit. As a result, increasing the rotational speed of the bit provides a greater ROP for the same WOB. Furthermore, embodiments of the present disclosure have been found to produce a bottom hole pattern that is relatively smooth and that shown at least no substantial signs of whirling in the borehole.

Additional embodiments of the disclosure comprise methods of making earth-boring tools. With reference to FIGS. 1-4, one or more embodiments of such methods may include forming a bit body 105 comprising a face 110 at a leading end thereof. The bit body 105 may be formed with a plurality of radially extending blades 115A-115H. The body 105 may be formed from a metal or metal alloy, such as steel, or a particle-matrix composite material such as a tungsten carbide matrix material. In embodiments where the bit body 105 is formed of a particle-matrix composite material, the bit body 105 may be formed by conventional infiltration methods (in which hard particles (e.g., tungsten carbide) are infiltrated by a molten liquid metal matrix material (e.g., a copper based alloy) within a refractory mold), as well as by newer methods generally involving pressing a powder mixture to form a green powder compact, and sintering the green powder compact to form a bit body 105. The green powder compact may be machined as necessary or desired prior to sintering using conventional machining techniques like those used to form steel bodies or steel plate structures. Indeed, in some embodiments, features (e.g., cutting element pockets, etc.) may be formed with the bit body 105 in a green powder compact state, or in a partially sintered brown body state. Furthermore, additional machining processes may be performed after sintering the green powder compact to the partially sintered brown state, or after sintering the green powder compact to a desired final density.

A plurality of cutting elements 135 may be disposed on the face 110 (e.g., in pockets 130 of one or more blades 115A-115H). The cutting elements 135 may be affixed on the face 110 of drill bit 100 by way of casting, brazing, welding, adhesively, mechanically or as otherwise known in the art. The cutting elements 135 may be positioned on the face 110 in kerfing pairs comprising two or more cutting elements 135 located at the same or substantially the same radial position. As noted above, the term "pair," as used herein, is a term of art denoting at least two cutting elements, and not limiting a group of cooperating kerfing cutting elements to only two. The plurality of cutting elements 135, the plurality of blades 115A-115H, or both may be configured to generate a relatively high net lateral force. For example, the cutting elements 135 may be selectively located and configured (sizes, relative exposures, side and back rakes, etc.) and/or the plurality of blades 115A-115H may be formed substantially asymmetrically on the face 110 of the bit body 105 such that the summation of each of the lateral drilling forces generated against each of the cutting elements 135 results in a net lateral force directed toward a side of the bit body 105.

In at least some embodiments, the cutting elements 135 may be positioned on the face 110 in two or more groups of cutting elements 135, each group comprising a plurality of cutting elements 135 having similarly sized cutting faces. The first group 310 may comprise cutting elements 135 having the largest sized cutting faces and may be positioned proximate to the bit axis 145. At least one more group (e.g., the second group 320, the third group 330, etc.) may comprise cutting elements 135 having cutting faces that are smaller in size than the cutting faces of the cutting elements 135 of the first group 310 and may be positioned radially outside from the first group 310 with respect to the bit axis 145.

Further embodiments of the disclosure comprise methods of forming a borehole. According to one or more embodiments, such methods include rotating an earth-boring tool, such as drill bit 100, and engaging a subterranean formation with a plurality of cutting elements 135 disposed on a plurality of blades 115A-115H extending radially over a face 110 of the earth-boring tool. A plurality of grooves are formed in the subterranean formation with some cutting elements 135 of the plurality of cutting elements 135, and some other cutting elements 135 of the plurality of cutting elements 135 rotationally follow at least substantially within the plurality of grooves. As the borehole is formed, a force is generated against the sidewall of the borehole by a rotating side of the drill bit 100. The force is generated against the sidewall by a lateral force directed toward a side of the bit body 105. The lateral force may comprise the summation of each of the lateral drilling forces generated by each of the cutting elements 135.

In some embodiments, the plurality of cutting elements 135 may comprise a first group 310 and at least a second group 320 positioned radially outward from the first group 310 relative to the bit axis 145, which may also be characterized as a central axis of the drill bit 100. The cutting elements comprising the first group 310 may have a larger cutting face than the cutting elements comprising the second group 320, as described herein above.

According to at least one other embodiment, methods of forming a borehole may include drilling a subterranean formation at a relatively low WOB with a rotary drill bit 100 comprising a plurality of cutting elements 135 disposed over a face of the drill bit. By way of example and not limitation, the relatively low WOB may comprise a weight less than about 20,000 lb. The rotary drill bit drilling at the relatively low WOB may be primarily stabilized with cutting elements 135 of the plurality of cutting elements 135 configured to comprise a plurality of kerfing pairs. The kerfing pairs comprise two or more cutting elements 135 disposed at the same or substantially the same radial distance from the bit axis 145 so that one or more cutting elements 135 follows in a groove formed by a preceding cutting element 135. The one or more cutting elements 135 of each kerfing pair following in the formed groove is restrained from lateral movement by the sidewalls of the groove, which may stabilize the drill bit 100.

The method may further include drilling the subterranean formation with the rotary drill bit 100 at a relatively high WOB. By way of example and not limitation, the relatively high WOB may comprise a weight of about 20,000 lb or greater. The rotary drill bit drilling at the relatively high WOB may be primarily stabilized by exerting a relatively high force against a sidewall of the borehole. For example, the drill bit 100 may be configured to generate a net lateral force sufficient to stabilize the drill bit 100 in use, and particularly when drilling at the relatively high weights-on-bit.

While certain embodiments have been described and shown in the accompanying drawings, such embodiments are merely illustrative and not restrictive of the scope of the disclosure, and this disclosure is not limited to the specific constructions and arrangements shown and described, since various other additions and modifications to, and deletions from, the described embodiments will be apparent to one of ordinary skill in the art. The scope of the invention, as exemplified by the various embodiments of the present disclosure, is limited only by the claims which follow, and their legal equivalents.

What is claimed is:

1. An earth-boring tool, comprising:

a body including a face at a leading end thereof and a plurality of blades extending from the body, the body including a cone region, a nose region, and a shoulder region;

a plurality of cutting elements disposed over the face, a first group of cutting elements of the plurality of cutting elements being located in the cone region and at least a second group of cutting elements of the plurality of cutting element being located in the shoulder region, the first group of cutting elements comprising a greater relative exposure than the second group of cutting elements, wherein at least some cutting elements of the plurality of cutting elements are disposed at same or substantially same radial position relative to a bit axis as one or more other cutting elements on different blades of the plurality of blades to follow same or substantially same cutting path when the bit is rotated about its axis; and wherein a summation of a lateral force generated during drilling by each cutting element of the plurality of cutting elements is directed toward a side of the body.

2. The earth-boring tool of claim 1, wherein the first group of cutting elements has larger cutting faces than the cutting faces of the second group of cutting elements.

3. The earth-boring tool of claim 2, wherein each cutting element of the first group of cutting elements has a larger cutting face than each cutting element of the second group of cutting elements.

4. The earth-boring tool of claim 3, wherein the cutting elements comprising the first group have cutting faces of about 13 mm in diameter, and the cutting elements comprising the second group have cutting faces of about 11 mm in diameter.

5. The earth-boring tool of claim 3, further comprising at least a third group of cutting elements positioned in the nose region, the cutting elements comprising the third group including smaller cutting faces than the cutting faces of the cutting elements comprising the first group and larger cutting faces than the cutting faces of the cutting elements comprising the second group.

6. A method of forming a borehole, comprising:

rotating an earth-boring tool and engaging a subterranean formation with a plurality of cutting elements disposed on a plurality of blades extending radially over a face of the earth-boring tool at least in a cone region, a nose region, and a shoulder region of the earth-boring tool;

engaging the subterranean formation with a first group of cutting elements of the plurality of cutting elements located in the cone region at a first relative exposure and with a second group of cutting elements of the plurality of cutting elements located in the shoulder region at a second, smaller relative exposure;

forming at least one groove in the subterranean formation with at least one cutting element of the plurality of cutting elements located on a first blade of the plurality of blades;

following at least substantially within the at least one groove with at least one other cutting element of the plurality of cutting elements located on a second, different blade of the plurality of blades; and generating a predetermined net lateral force against a sidewall of the borehole with a rotating side of the earth-boring tool, the predetermined net lateral force comprising a summation of a lateral force generated during drilling by at least some cutting elements of the plurality of cutting elements.

* * * * *